US006018637A

United States Patent [19]

Huss et al.

[11] Patent Number: 6,018,637

[45] Date of Patent: Jan. 25, 2000

[54] REPRODUCTION MACHINE INCLUDING A DEVELOPER MATERIAL CARTRIDGE HAVING A LABEL ASSEMBLY REUSEABLE AS A SEALING DEVICE

[75] Inventors: Timothy L. Huss, Ontario; Paul M. Wegman, Pittsford, both of N.Y.

[73] Assignee: Xerox Corporation, Stamford, Conn.

[21] Appl. No.: 09/124,788

[22] Filed: Jul. 30, 1998

[51] Int. Cl.[7] ..... G03G 21/00

[52] U.S. Cl. ..... 399/102; 220/361; 399/119; 399/120

[58] Field of Search ..... 399/102, 119, 399/120, 255, 256, 358, 360; 220/359.1, 361

[56] References Cited

U.S. PATENT DOCUMENTS

| | | | |
|---|---|---|---|
| 4,522,487 | 6/1985 | Misawa | 399/102 |
| 4,886,504 | 12/1989 | Arvidson et al. | 604/257 |
| 5,027,156 | 6/1991 | Kobayashi | 399/106 |
| 5,428,436 | 6/1995 | Sundquist et al. | 399/360 |
| 5,495,323 | 2/1996 | Meetze, Jr. | 399/120 |
| 5,686,159 | 11/1997 | Langan | 428/40.1 |

*Primary Examiner*—William Royer
*Assistant Examiner*—William A. Noē
*Attorney, Agent, or Firm*—Tallam I. Nguti

[57] ABSTRACT

An electrostatographic reproduction machine including a movable photoconductive member having an image bearing surface; devices for forming a latent image electrostatically on the image bearing surface; a development unit including toner particles for developing the latent image to be transferred onto a sheet; a moving device for moving waste toner particles from the image bearing surface and from the development unit; and a waste developer material cartridge having a housing defining a surface area, a waste developer material chamber, and a waste developer material receiving opening for receiving waste developer material from the moving device, wherein the waste developer material cartridge housing has an accessible sealing device mounted over the receiving opening; and a label assembly reuseable as a sealing device for effectively resealing the accessibly-sealed waste developer material receiving opening during shipping of the cartridge. The label assembly-sealing device includes a first label member for attaching permanently to a portion of the surface area of the housing; detailed instructions on the first label member on resealing and shipping the waste developer material cartridge for recycling; and a second and removable label member-sealing device mounted removably onto the first label member for removal and reuse to effectively reseal the accessibly-sealed waste developer material receiving opening during shipping of the cartridge. The second and removable label member has simple label instructions thereon directing the customer to remove it and to read the detailed instructions on the first label member thereunder before shipping the waste developer material cartridge to a distant location for recycling.

7 Claims, 5 Drawing Sheets

REPRODUCTION MACHINE INCLUDING A DEVELOPER MATERIAL CARTRIDGE HAVING A LABEL ASSEMBLY REUSEABLE AS A SEALING DEVICE

RELATED APPLICATION

This application is related to U.S. application Ser. No. 09/126,159 (now allowed) (Applicants' Docket NO. D/96777) entitled "REPRODUCTION MACHINE INCLUDING A DEVELOPER MATERIAL CARTRIDGE HAVING A NON-INTERFERING DUAL-USE SEALING DEVICE" on the same day as the present application and having at least one common inventor.

BACKGROUND

This invention relates to electrostatographic reproduction machines, and more particularly to such a machine including a developer material cartridge having a label assembly reusable as a sealing device.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner material adhering triobelectrically thereto. A single component dry developer material typically comprising toner material only can also be used. The toner image formed by such development is subsequently transferred at a transfer station onto a copy sheet fed to such transfer station, and on which the toner material image is then heated and permanently fused so as to form a "hardcopy" of the original image.

One familiar type of development of an electrostatic image is called "two-component development" because it utilizes two-component developer. Two-component developer largely comprises toner material interspersed with carrier material The carrier material is magnetically attractable, and the toner material is, caused to adhere triboelectrically to the carrier material. This two-component developer can be conveyed, by means such as a "magnetic roll," to the electrostatic latent image, where toner material becomes detached from the carrier material and adhere as desired to the electrostatic latent image.

Development of the electrostatic image with developer material results in the generation of waste developer material which is removed and stored in a waste sump disposed within the electrostatographic reproduction machine. A waste sump is designed with one or more openings which allow an auger to deposit waste developer material inside the sump. When full, the waste sump is removed from the electrostatographic reproduction machine. Prior to removal of the waste sump, the openings of the waste sump need to be sealed to minimize spillage of the waste developer material. As disclosed for example in U.S. Pat. No. 5,428,436, it is known to provide a waste sump seal member which attempts to prevent or minimize waste developer particle spillage during removal of the waste sump from the machine. Such a waste sump seal member does so by automatically attempting to seal or reclose a waste sump opening immediately upon withdrawal of a waste toner developer material delivery auger from the waste sump opening.

Typically, the seal member for the waste sump opening as disclosed, is slotted and designed mainly to keep the waste toner from leaking during waste toner delivery into the waste sump. However, it has been found that the slotted seal member leaks toner during harsh shipping movements of the removed waste sump to a distant location for recycling purposes. Consequently, the customer or operator must place the waste sump after removal from the machine, into a bag prior to such shipment. The bags and bagging operation required for this are of course costly and time consuming.

Further, it has been found that such repackaging or bagging is not adequate to prevent waste toner or developer material from spilling out of the waste sump through the slits and into the bag or container, and thus making a mess all over the bagged cartridge or waste sump. The bags, the spilled waste toner and the mess on the sump of course further complicate handling and recycling efforts.

There is therefore a need for a sealing device which is easily available to the customer or operator, is easy to use, and which can further seal the waste sump opening against waste developer material spillage even during harsh shipping movements to distant locations for recycling.

SUMMARY OF THE INVENTION

In accordance with the present invention, there is provided an electrostatographic reproduction machine including a movable photoconductive member having an image bearing surface; devices for forming a latent image electrostatically on the image bearing surface; a development unit including toner particles for developing the latent image to be transferred onto a sheet; a moving device for moving waste toner particles from the image bearing surface and from the development unit; and a waste developer material cartridge having a housing defining a surface area, a waste developer material chamber, and a waste developer material receiving opening for receiving waste developer material from the moving device, wherein the waste developer material cartridge housing has an accessible sealing device mounted over the receiving opening; and a label assembly reusable as a sealing device for effectively resealing the accessibly-sealed waste developer material receiving opening during shipping of the cartridge. The label assembly-sealing device includes a first label member for attaching permanently to a portion of the surface area of the housing; detailed instructions on the first label member on resealing and shipping the waste developer material cartridge for recycling; and a second and removable label member-sealing device mounted removably onto the first label member for removal and reuse to effectively reseal the accessibly-sealed waste developer material receiving opening during shipping of the cartridge. The second and removable label member has simple label instructions thereon directing the customer to remove it and to read the detailed instructions on the first label member thereunder before shipping the waste developer material cartridge to a distant location for recycling.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
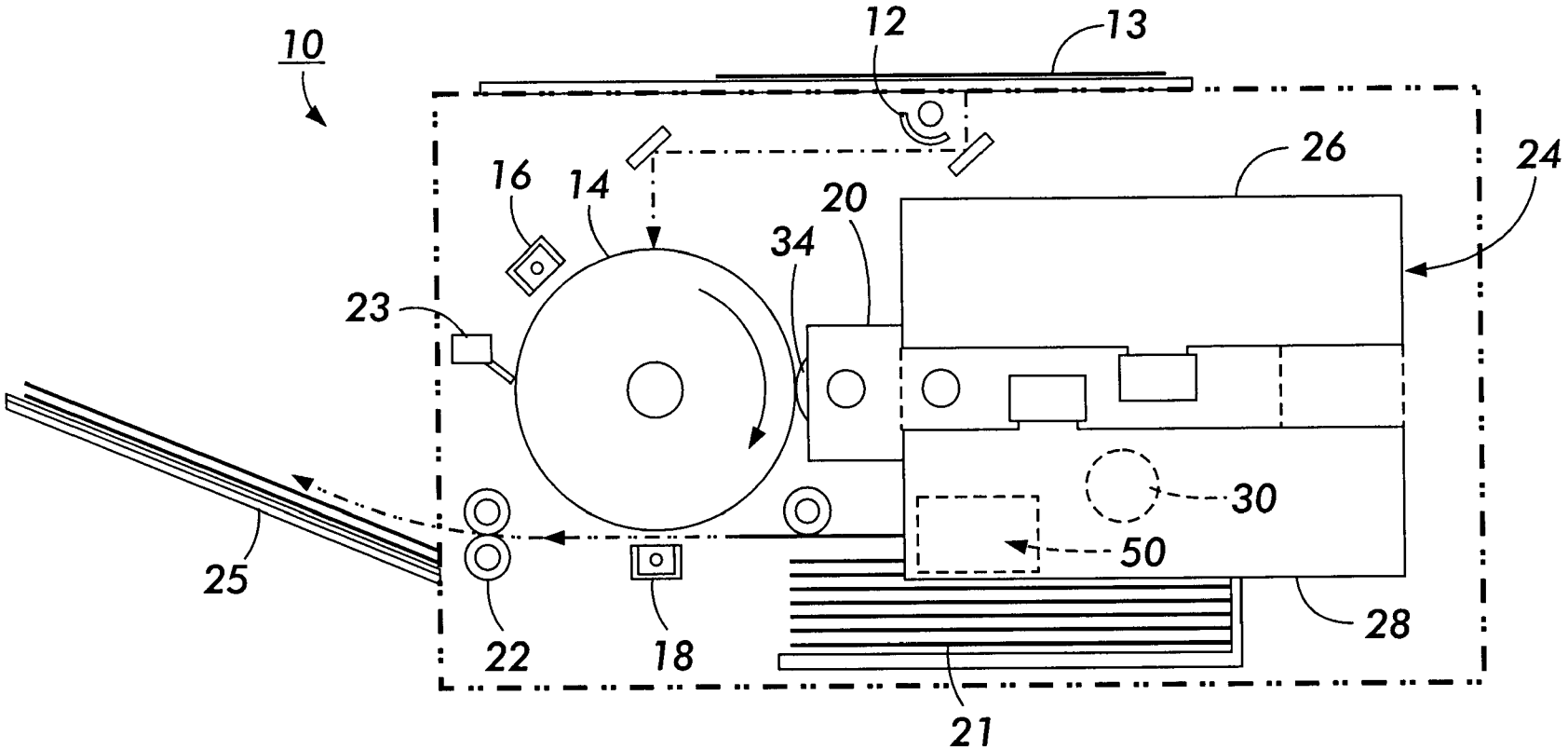
FIG. 1 is a schematic, side view showing the elements of an electrostatographic reproduction machine, in this case a copier, including the developer material cartridge having the label assembly reusable as a sealing device according to the present invention.
Figure 2:
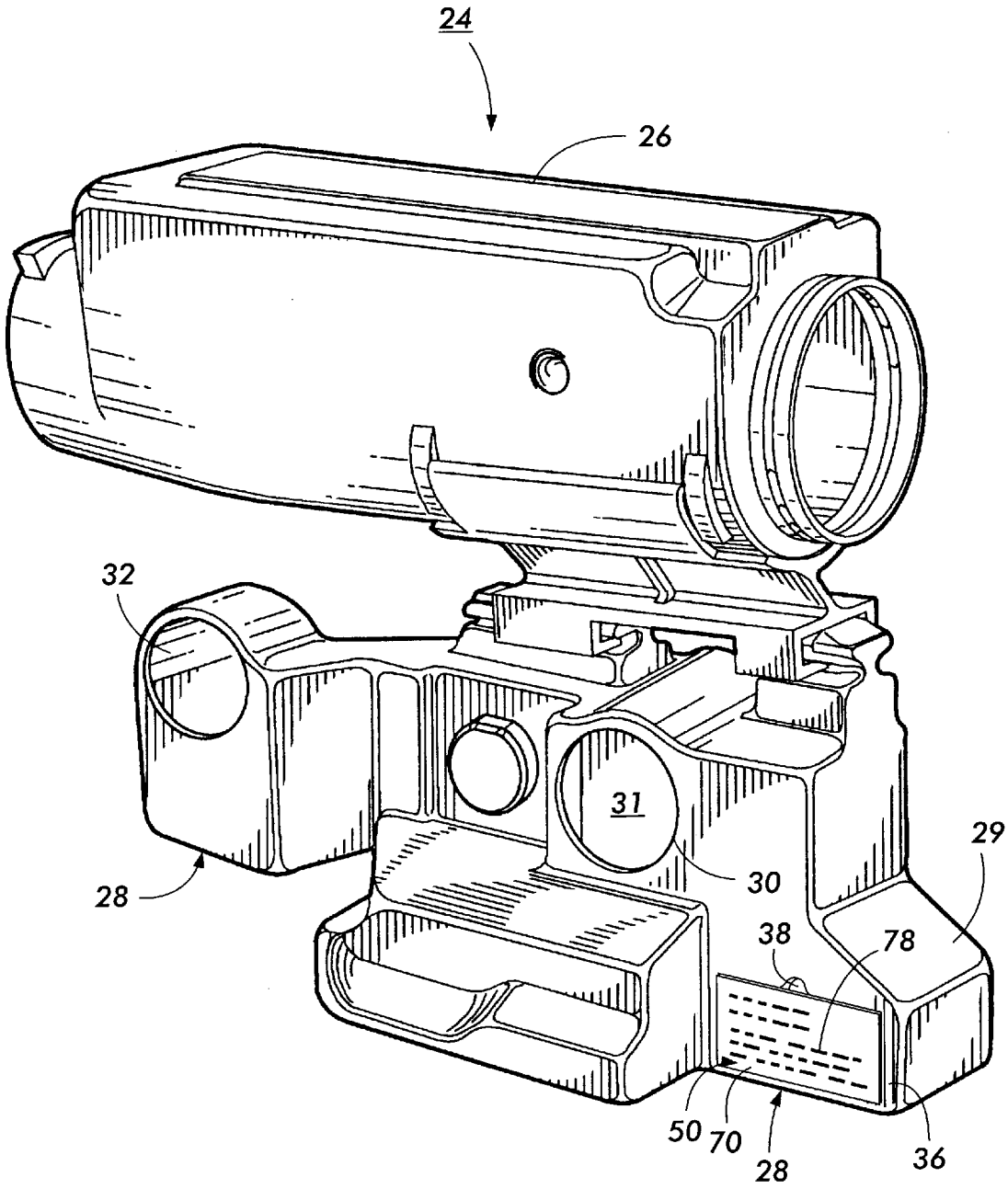
FIG. 2 is a perspective, schematic view of the developer material cartridge of the machine of FIG. 1 showing an open, unsealed waste sump opening, and the label assembly to be reused as a sealing device in accordance with the present invention.

Referring now to FIGS. 1–2, the basic elements of an electrostatographic reproduction machine, in this case a copier 10, and the developer material cartridge of the present invention are shown. As illustrated, the copier 10 includes an exposure means 12, which may include a lamp, a mirror, and a self-focusing lens arrangement for obtaining an exposure of an original image on a sheet 13 to be copied. The original image on sheet 13 is exposed onto the surface of a moving photoreceptor 14 (shown as a rotatable drum) which has been previously charged by means of a corotron device 16. When the charged surface of photoreceptor 14 is exposed to a light image of the original image on sheet 13, various portions of the surface will be discharged in imagewise fashion. Those areas of the photoreceptor 14 which were not discharged during such exposure, for example, can be the image areas, and are then developed with developer material by development unit 20, and in particular by a magnetic developer roll 34. Developer material may be single component comprising toner particles only, or it may dual component, comprising toner particles and carrier particles.

During development by the development unit 20, the toner particles of the developer material are caused to adhere to the image areas of photoreceptor 14, thus creating a visible or "developed" image of the original. This developed image is then moved, by the rotation of photoreceptor 14, to a transfer station 18, where the image forming toner on the photoreceptor is electrostatically transferred to a sheet of plain paper fed from a stack 21 of such sheets. After such image transfer, waste or residual toner particles remaining on the surface of the photoreceptor 14, are removed or cleaned off by a cleaning device 23, and transported for example by an auger (not shown) to the waste developer material sump portion of the cartridge of the present invention (to be described below). The sheet from stack 21 which receives the transferred toner image, is subsequently sent through a fuser 22, which causes the toner material to be melted and fused onto the sheet to form a permanent copy of the original image.

It is well known in the art to provide fresh developer material, such as that above, in a customer replaceable unit (CRU) or cartridge. In accordance with the present invention, a developer material cartridge or CRU, shown generally as 24 and containing fresh developer material, is provided for supplying such developer material to the development unit 20. The cartridge 24, for example can be of the type usable in a "trickle" development process. A conventional example of such a cartridge is disclosed in U.S. Pat. No. 5,428,436 issued Jun. 27, 1995. Trickle development as a process is discussed for example in Folkins et al., U.S. Pat. No. 4,614,165, the disclosure of which is incorporated herein by reference.

In summary however, it should be understood that in trickle development, there is provided a main supply of developer material containing both toner and carrier particles, which is drawn upon for application to an electrostatic latent image on photoreceptor 14. There is also provided a second supply of developer material, which gradually discharges, or trickles, into the main developer material supply. In most embodiments of trickle development, the main and secondary supplies of developer material have substantially different percentages of toner particles to carrier particles (also referred to herein as "TIC"). The main supply of developer material is retained in the development unit 20, while the secondary supply of developer material is discharged from a CRU or cartridge, such as 24, into the development unit 20. Simultaneously, in order to maintain both a relatively stable amount of developer material in the development unit 20, and also to maintain the TIC of the developer material in development unit 20 within an optimal range, a certain quantity of developer material is discharged as waste or used developer material from the development unit 20 into the waste sump portion of the CRU or cartridge 24.

Figure 3:
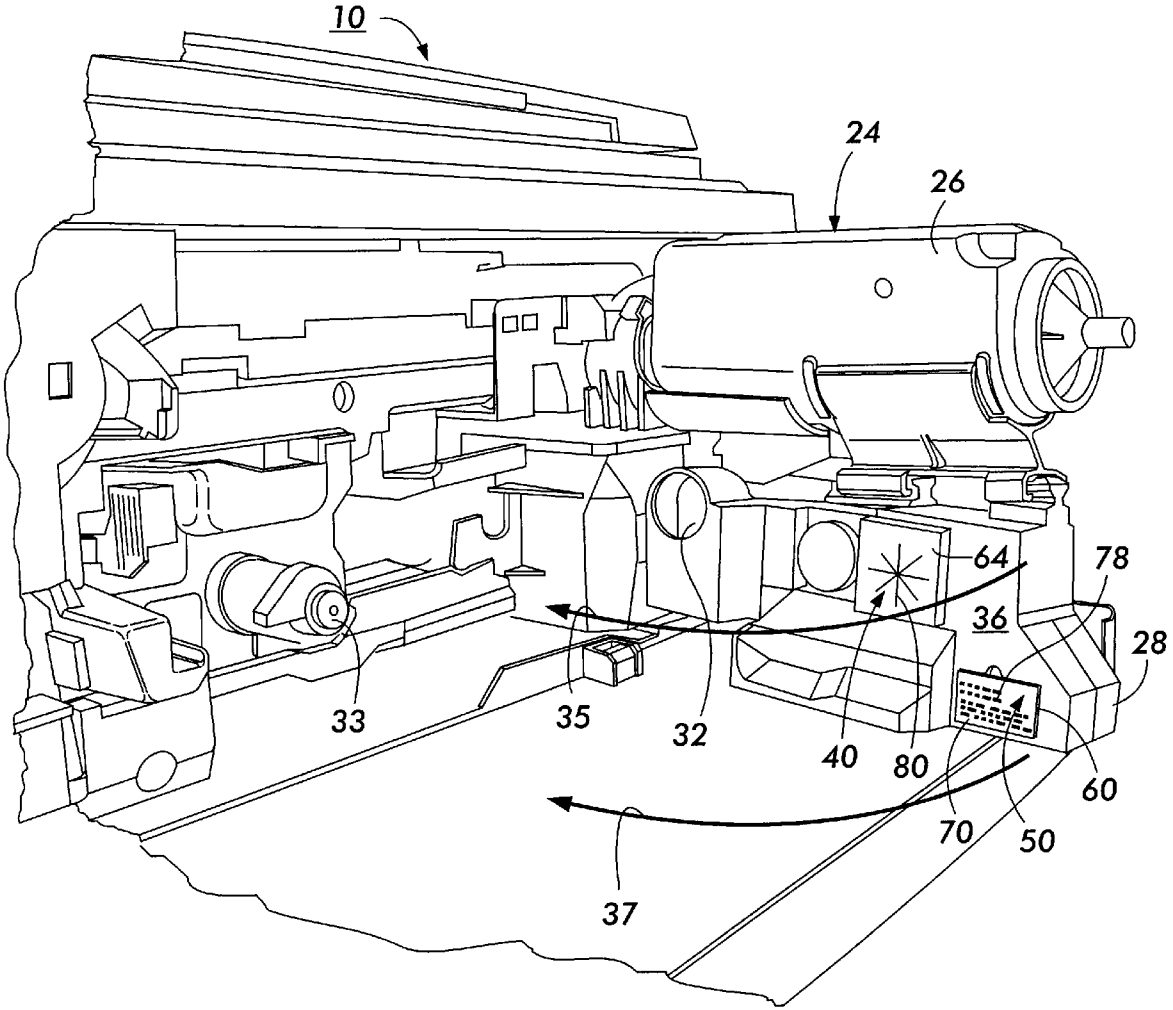
FIG. 3 is a perspective, schematic view of a portion of the machine of FIG. 1, showing the developer material cartridge assembled and in a pulled-out position, showing the waste sump opening presealed with an accessible sealing device that will be oversealed with the label assembly-sealing device of the present invention.

Still referring to FIGS. 1–3, there can be seen, interacting with development unit 20, the developer material cartridge 24 of the present invention. As further shown, the cartridge 24 includes a fresh developer material container 26, and a waste developer material container or waste sump 28. The waste sump 28 as shown (FIG. 2) has 2 openings 30 and 32. In the copier or machine 10, a dispense or delivery auger 33 dribbles waste toner into the first sump opening 30. A coupling member (not shown) couples the container 26 to the container or waste sump 28. In general, the container 26 which contains and supplies fresh developer material, can contain either toner particles only (single component case), or toner and carrier particles (dual component case). The waste sump or container 28 has a housing 29 that defines a waste chamber 31, and at least an opening 30 for receiving waste developer material into the chamber 31. The housing defines a surface area. A portion of such surface area for mounting the label assembly of the present invention is recessed, relative to a rest of such surface area, for containing and preventing damage to the label assembly.

Importantly, the developer material cartridge 24 includes the label assembly 50 of the present invention. The label assembly should be mounted in an area and at a position that is most easily visible to an operator handling the cartridge 24, particularly when removing the filled waste sump portion 28 for shipment to a recycling location. As shown in FIGS. 1 and 2, such an area is on a surface of the housing 29 adjacent the waste sump opening 30 itself.

Referring to FIG. 3 in particular, the cartridge 24 of the present invention is shown assembled into the machine 10, for example, and in a pulled out position. Specifically, FIG. 3 is a perspective, schematic view of a portion of the machine 10, showing the developer material cartridge 24 in the pulled-out position, with a slitted reclosing resilient presealing device 40 already mounted over the waste sump 30 for allowing access for a waste developer material delivery auger 33. The delivery auger 33 is designed and positioned in the machine 10 for fitting through the slits 80 of the resilient presealing device 40 and into the waste sump opening 30 when the cartridge 24 is moved from its pull-out position (FIG. 3) into a pushed-in assembled position, (not shown). The resilient presealing device 40 is sized to just cover and accessibly seal over the waste sump opening 30. As further shown in FIG. 3, the cartridge 24 is moved into the pushed-in position, by moving it in the direction of the arrows 35, 37.

Figure 4:
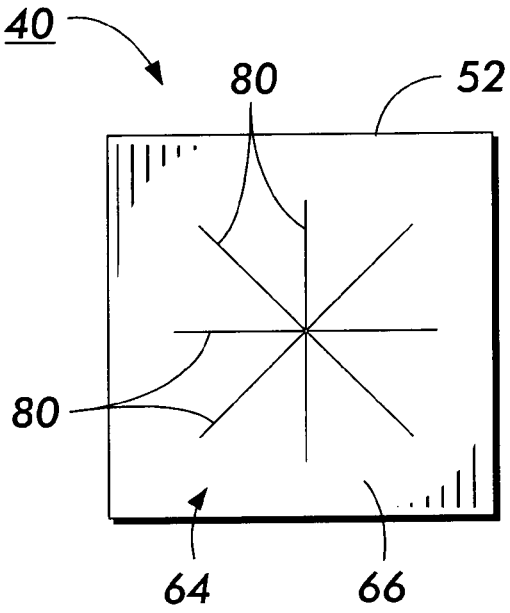
FIG. 4 is a front view of the accessible sealing device having a slitted resilient member for presealing the waste sump opening of FIG. 2.
Figure 5:
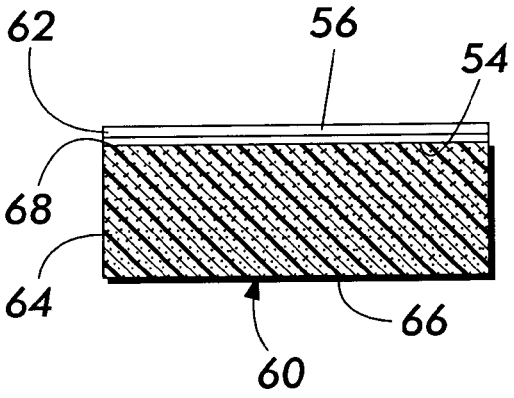
FIG. 5 is a section of the accessible sealing device of FIG. 4.
Figure 6:
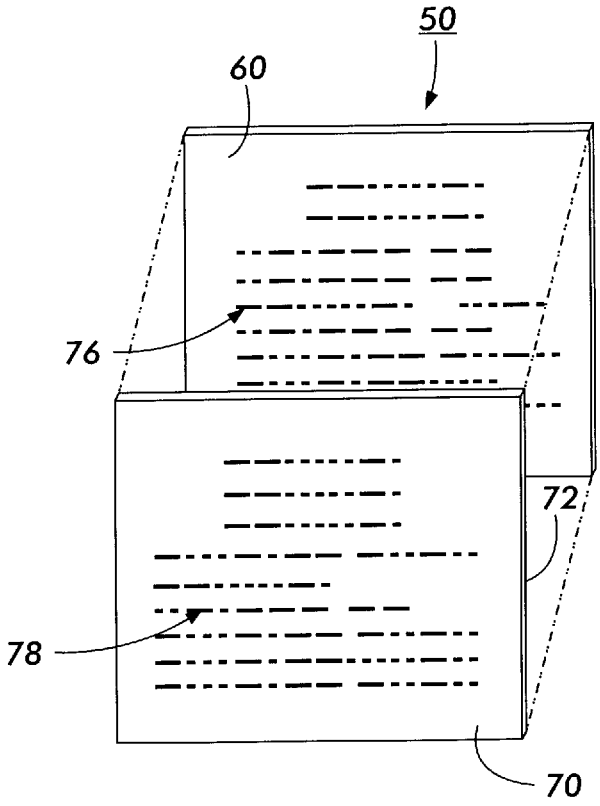
FIG. 6 is an exploded view of the first and second label members of the label assembly-sealing device of the present invention.
Figure 7:
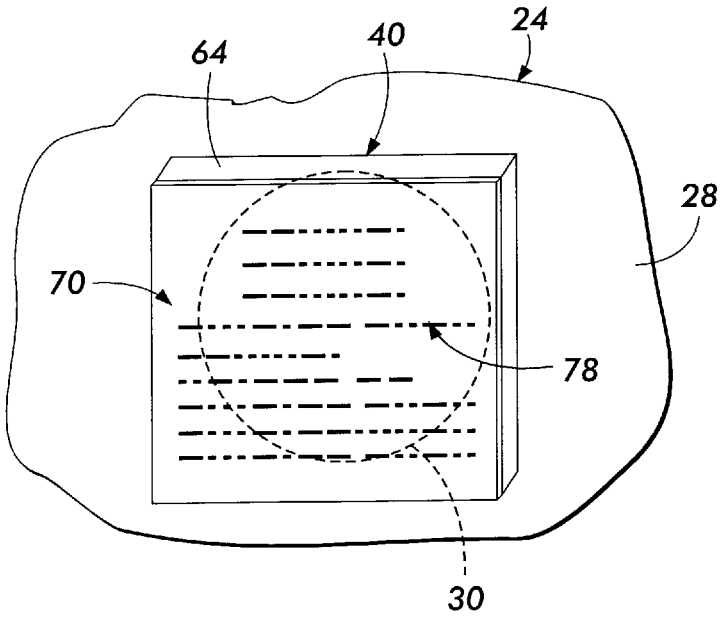
FIG. 7 is a schematic front view of a portion of the developer material cartridge of FIG. 3 removed from the machine, and showing the label assembly-sealing device of the present invention reused and oversealing the accessible presealing device on the waste sump opening.

Referring now to FIGS. 3–5, the accessible presealing device 40 for example comprises a substrate 52 having a first side 54, a second side 56 for mounting over the waste sump opening 30 of the container 28. A first adhesive layer 62 is applied to the second side 56 for adhering and mounting the second side 56 over the opening 30, as shown in FIG. 3. The resilient member 64, has a top side 66 and a bottom and opposite side 68, that is attached to the first side 54 so as to be directly over the waste sump opening 30 when the presealing device 40 is mounted over the opening 30. As shown, the resilient member 64, and the substrate 52, each include multiple, centered and crossing slits 80 that are formed therethrough, from the top side 66 of the resilient member 64 through to the second side 56 of the substrate 52. The slits 80 are suitable for enabling access by the auger 33 through the resilient member 64, and opening 30 into the chamber 31, (hence the resilient member and substrate are considered as providing accessible presealing over the opening 30). Thus the slits 80 enable receiving of a particulate material delivery device such as the auger 33 into the opening 30 and yet also enables sealing against the auger and against particulate material leakage during particulate material delivery and receiving into the chamber 31.

Importantly, the label assembly-sealing device 50 includes a first adhesive layer 62 on a back side of the first label member 60 for permanently attaching the first label member 60 to a portion 38 of the surface area 36 on the housing 29. It also includes a second adhesive layer 72 that is applied to the back side of the second removable label member-sealing device 70 for removably adhering the second member to the front side of the first member 60, and strongly adhering and mounting onto the top side 66 of the resilient member 64 as instructed, hence sealing the slits 80 and resealing against any access through the opening 30, and thus preventing waste developer material leakage during shipping of the waste sump 28 containing received waste developer material.

As further illustrated, the first label member 60 detailed instructions 76 on its front side on how to reseal and ship the waste developer material cartridge for recycling. The second and removable label member-sealing device 70 is removable for reuse to effectively reseal the accessibly-sealed waste developer material receiving opening during shipping of the cartridge. It includes simple label instructions 78 thereon directing the customer to remove it and to read the detailed instructions 76 on the first label member 60 thereunder before shipping the waste developer material cartridge to a distant location for recycling.

With the label assembly-sealing device of the present invention mounted to the surface area of the cartridge 24 as described above, the cartridge 24 is then assembled into the machine 10. During such assembly, a delivery tip of the auger 33 (FIG. 3) carrying waste toner or developer material is brought into contact with the top surface 66 of the resilient member 64 of the presealing device 40, when the cartridge 24 is moved in the direction of the arrows 35, 37 into a pushed-in assembled position. The auger 33 pushes against the top surface 66, causing the slits 80 to admit the auger which compresses the resilient material 64 inwardly as it pushes through both the resilient material and the substrate 52, and through the opening 30 into the chamber 31. A discharge aperture (not labeled) in the auger 33 is positioned for delivering waste developer material into the chamber 31, when the auger is fully inserted into the waste sump 28. When the auger 33 is withdrawn from the chamber 31, and from the presealing device 40, the resilient material 64 is supposed to spontaneously and immediately re-expand to reclose the slits 80 in an attempt to prevent waste developer material within the chamber 31 from spilling or leaking through the slits 80. It has been found however, that such re-expansion of the resilient member is not sufficient to prevent waste developer material spilling or leaking, particularly during any shipping of the sump 28 to a distant location for recycling.

The present invention provides a highly likely and cost effective label assembly that is mounted as above for instructing the customer or operator about any aspect of the operation of the machine, and also about its removal and reuse for resealing the slits 80 over the waste sump opening 30 prior to such shipping. This makes it possible to ship the cartridge 24 or waste sump 28 without waste developer material spilling or leaking. The label assembly-sealing device 50 importantly eliminates the need to use extra repackaging containers such as bags. It also eliminates spillage from the waste sump into the extra container or bags, and hence the mess, handling problems and recycling complications that result from such spillage.

While the embodiment of the present invention disclosed herein is preferred, it will be appreciated from this teaching that various alternative, modifications, variations or improvements therein may be made by those skilled in the art, which are intended to be encompassed by the following claims:

What is being claimed is:

1. An electrostatographic reproduction machine comprising:

(a) a movable photoconductive member having an image bearing surface;

(b) means for forming a latent image electrostatically on said image bearing surface;

(c) developing means including toner particles for developing the latent image to be transferred onto a sheet;

(d) moving means for moving waste toner particles from said image bearing surface and from said developing means;

(e) a waste developer material cartridge having a housing defining a surface area having a portion for receiving a label assembly, a waste developer material chamber, and a waste developer material receiving opening for receiving waste developer material from said moving means, said waste developer material cartridge housing having an accessible sealing device mounted over said receiving opening; and (f) a label assembly reusable as a sealing device for effectively resealing said waste developer material receiving opening during shipping of said cartridge, said label assembly including a first label member for attaching permanently to a portion of said surface area of said housing; detailed instructions on said first label member on resealing and shipping said waste developer material cartridge for recycling; and a second removable label member mounted removably onto said first label member for removal and reuse to effectively reseal said waste developer material receiving opening of said waste developer material cartridge during shipping of said cartridge, said second removable label member having simple label instructions thereon directing a customer to remove it and to read said detailer instructions on said first label member thereunder before shipping said waste developer material cartridge to a distant location for recycling.

2. The electrostatographic reproduction machine of claim 1, wherein said moving means comprises a waste toner particle delivery auger for insertion through slits in the accessible presealing device and through said receiving opening for delivering waste toner into a waste sump portion of said waste developer material cartridge.

3. The electrostatographic reproduction machine of claim 1, wherein said waste developer material cartridge comprises a fresh developer material container and a waste developer material container having said waste developer material receiving opening.

4. The electrostatographic reproduction machine of claim 1, wherein said portion of said surface area for mounting said label assembly is recessed relative to a rest of said surface area for containing, and preventing damage to, said label assembly.

5. The electrostatographic reproduction machine of claim 1,wherein said first label member includes a first adhesive layer on a back first side thereof for attaching said the first side to said portion of said surface area of said housing.

6. The electrostatographic reproduction machine of claim 5, wherein said second removable label member includes a second adhesive layer for attaching said second removable label member removably to a front second side of said first label member and for permanently attaching said second removable label member to said waste developer material receiving opening of said waste developer material cartridge during shipping of said cartridge.

7. The electrostatographic reproduction machine of claim 6, wherein said first label member has on the front second side thereof specific instructions on how to reuse said second removable label member for effectively sealing over said waste developer material receiving opening during shipping of said cartridge to prevent waste developer material leakage during such shipping.

* * * * *